US006950526B2

(12) United States Patent
Garstick

(10) Patent No.: US 6,950,526 B2
(45) Date of Patent: Sep. 27, 2005

(54) SOUND MASKING AND PAGING SYSTEM

(75) Inventor: Jeffrey R. Garstick, Ballwin, MO (US)

(73) Assignee: Lowell Manufacturing Company, Pacific, MO (US)

( * ) Notice: Subject to any disclaimer, the term of this patent is extended or adjusted under 35 U.S.C. 154(b) by 104 days.

(21) Appl. No.: 10/420,502

(22) Filed: Apr. 22, 2003

(65) Prior Publication Data

US 2004/0013281 A1 Jan. 22, 2004

Related U.S. Application Data

(60) Provisional application No. 60/374,711, filed on Apr. 23, 2002.

(51) Int. Cl.[7] ..... H04R 3/02

(52) U.S. Cl. ..... 381/73.1; 381/82

(58) Field of Search ..... 381/73.1, 82, 87, 381/332, 345, 349, 352, 160, 386, 391; 340/311.2

(56) References Cited

U.S. PATENT DOCUMENTS

| | | | | |
|---|---|---|---|---|
| 2,830,330 A | | 4/1958 | Heath | |
| 3,912,865 A | | 10/1975 | Seebinger | |
| 3,985,957 A | * | 10/1976 | Torn | 381/73.1 |
| 4,057,689 A | | 11/1977 | Stallings, Jr. | |
| 4,059,726 A | * | 11/1977 | Watters et al. | 381/73.1 |
| 4,330,691 A | | 5/1982 | Gordon | |
| 4,484,658 A | | 11/1984 | Grote | |
| 4,509,192 A | | 4/1985 | Straughn | |
| 4,727,587 A | | 2/1988 | Black | |
| 4,923,032 A | | 5/1990 | Nuernberger | |
| 5,088,574 A | | 2/1992 | Kertesz, III | |
| 5,316,254 A | | 5/1994 | McCartha | |
| 5,533,306 A | | 7/1996 | Aspenson | |
| 6,164,408 A | * | 12/2000 | Lamm et al. | 381/73.1 |

OTHER PUBLICATIONS

Quam–Nichols Co.; The TR Lay–in Speaker System from Quam; Web site pages, 2001.

Atlas Sound,; 1'x2' Drop–In Speaker Systems, Installs Hassle–Free; Atlas Sound Product Catalog; 2001.

* cited by examiner

*Primary Examiner*—Ping Lee

(74) *Attorney, Agent, or Firm*—Husch & Eppenberger, LLC; Rebecca J. Brandau

(57) ABSTRACT

The new speaker system includes masking capabilities, as well as optional paging capabilities and has a speaker mounted so as to be upwardly directed on a support plate or rack within a ceiling plenum, with an optional low profile backbox. An optional paging speaker is mounted within the backbox downwardly facing on the support rack.

12 Claims, 8 Drawing Sheets

SOUND MASKING AND PAGING SYSTEM

CROSS REFERENCE TO RELATED APPLICATION

This application relies upon and claims benefit of the filing date of pending provisional patent application No. 60/374,711, filed Apr. 23, 2002.

BACKGROUND OF INVENTION

The present invention relates, generally to sound and speaker systems, and, more particularly, to a system for sound masking, and alternatively, for simultaneously providing paging.

Traditionally, sound masking systems for use in work cubicles, for example, have been exemplified by floor supported, plug-in electrical devices providing, e.g., "white-noise" to mask or to completely hide unwanted sounds, such as voices from another cubicle or adjacent room, or sounds which cause distraction to workers, or simply for privacy of a conversation from any individuals nearby.

Heretofore, there has not been known a sound masking system, which is ceiling mounted, as described herein, or which can be adapted for inclusion of a paging system.

SUMMARY OF THE INVENTION

The present invention is intended to be used primarily, although not necessarily, with a lay-in tile speaker support system owned by the inventors hereof and which is disclosed and claimed in pending U.S. patent Ser. No. 09/972,465, filed Oct. 5, 2001, the disclosure of which is incorporated herein by reference in its entirety. When that disclosure is considered, it will be apparent that the present system can be installed on a "one by two" (one foot by two feet) platform, filling only the space of one-half the ceiling tile, or on a two feet by two feet platform system, filling the entire tile area.

The proposed new paging/speaker system is designed for use on a speaker support platform and includes a preferably low profile backbox supported, for example, on the top of a lay-in tile speaker support, replacing the area otherwise occupied by one-half or all of a ceiling tile. The new system may include only a speaker for providing sound masking, with the speaker positioned on or above the lay-in tile facing upwardly so that sound bounces off the surrounding ceiling plenum structure and back down through the adjacent grill and to some extent through the ceiling around the support system. If two speakers are used, one for masking and one for paging the speakers may be of the same size, or differently sized. The speakers can also vary in other known respects, such as in weight, or whether or not they are coaxial. A variety of useful speaker specification combinations can be conceived by one skilled in the art.

Accordingly, it is among the objects of the present invention to provide a sound masking which is conveniently mounted out of the way, usually within a ceiling, and which can be mounted and used in combination with paging system.

In furtherance of the above objects and goals, the present invention is, briefly, a speaker system for masking sound, comprising a support platform for supporting at least one speaker within a ceiling plenum. A speaker backbox is supported on the support platform within the ceiling plenum and at least one speaker is supported within the backbox above the platform in an upwardly facing position to thereby project masking sound upwardly so that the sound waves will bounce off an interior of the backbox within which the system is supported and then downwardly, so as to be attenuated before reaching the ears of a person within hearing range of the speaker system.

The present invention is also, briefly, the above-described system, wherein the at least one speaker is at least two speakers. One of the speakers faces upwardly and the other of the speakers faces downwardly, the downwardly facing speaker for providing paging capability simultaneously with the masking function of the speaker system.

BRIEF DESCRIPTION OF DRAWINGS

Throughout the drawings like parts are indicated with like element numbers.

DETAILED DESCRIPTION

Figure 1:
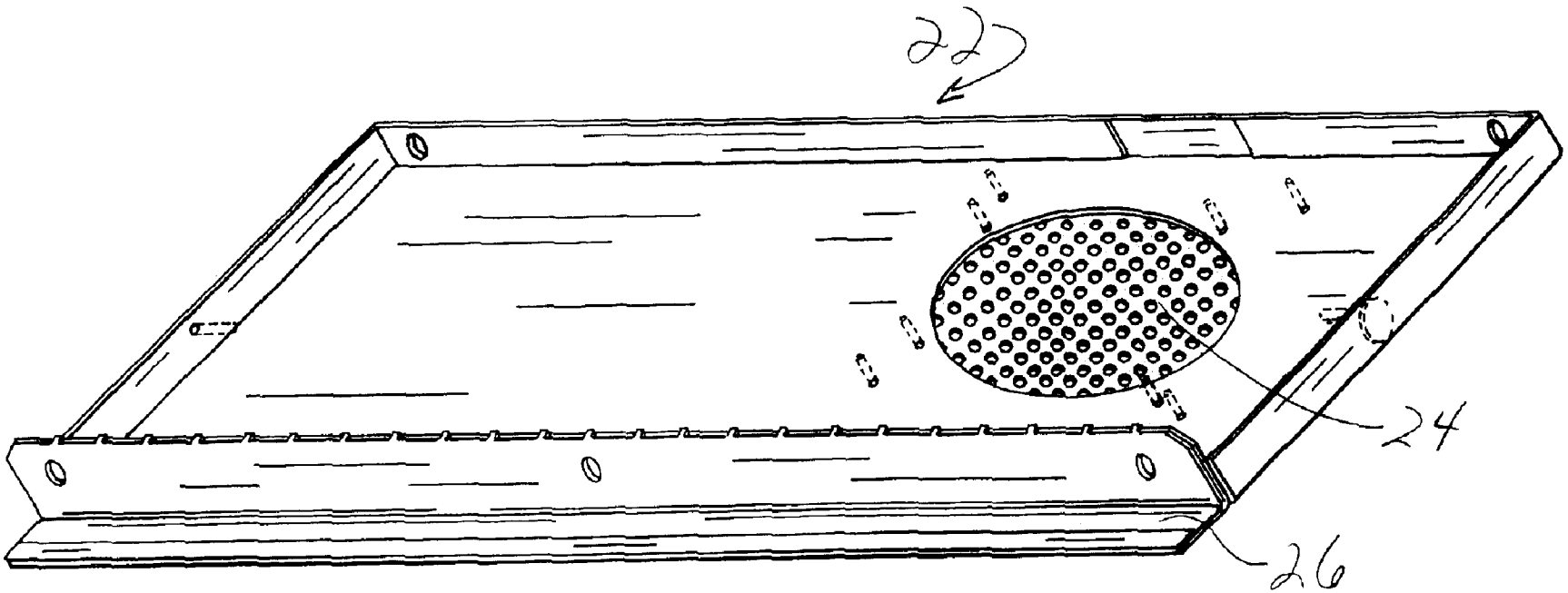
FIG. 1 (PRIOR ART)
FIG. 1 is an upper perspective view of a lay-in tile speaker support of the one-half tile ("one by two") size for support of a sound masking and paging system constructed in accordance with the present invention and showing the grill opening for a downward facing paging speaker and speaker connections.
Figure 2:
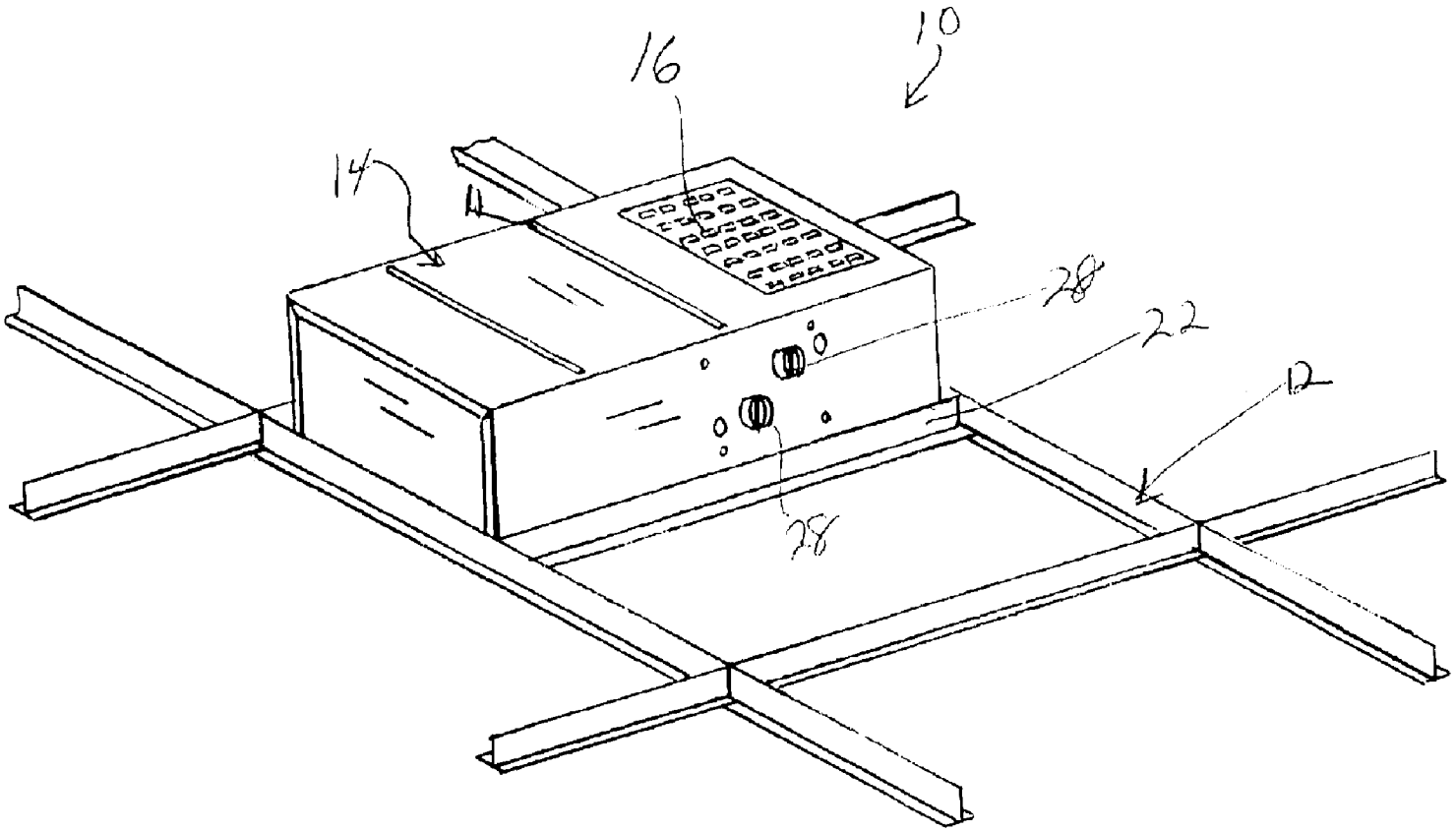
FIG. 2 is an upper perspective view of a sound masking and paging system ("single size, one by two, box") shown mounted on a ceiling grid of the type used for installing conventional ceiling tiles and filling substantially one-half of the area defined by the ceiling tile support grid.
Figure 3:
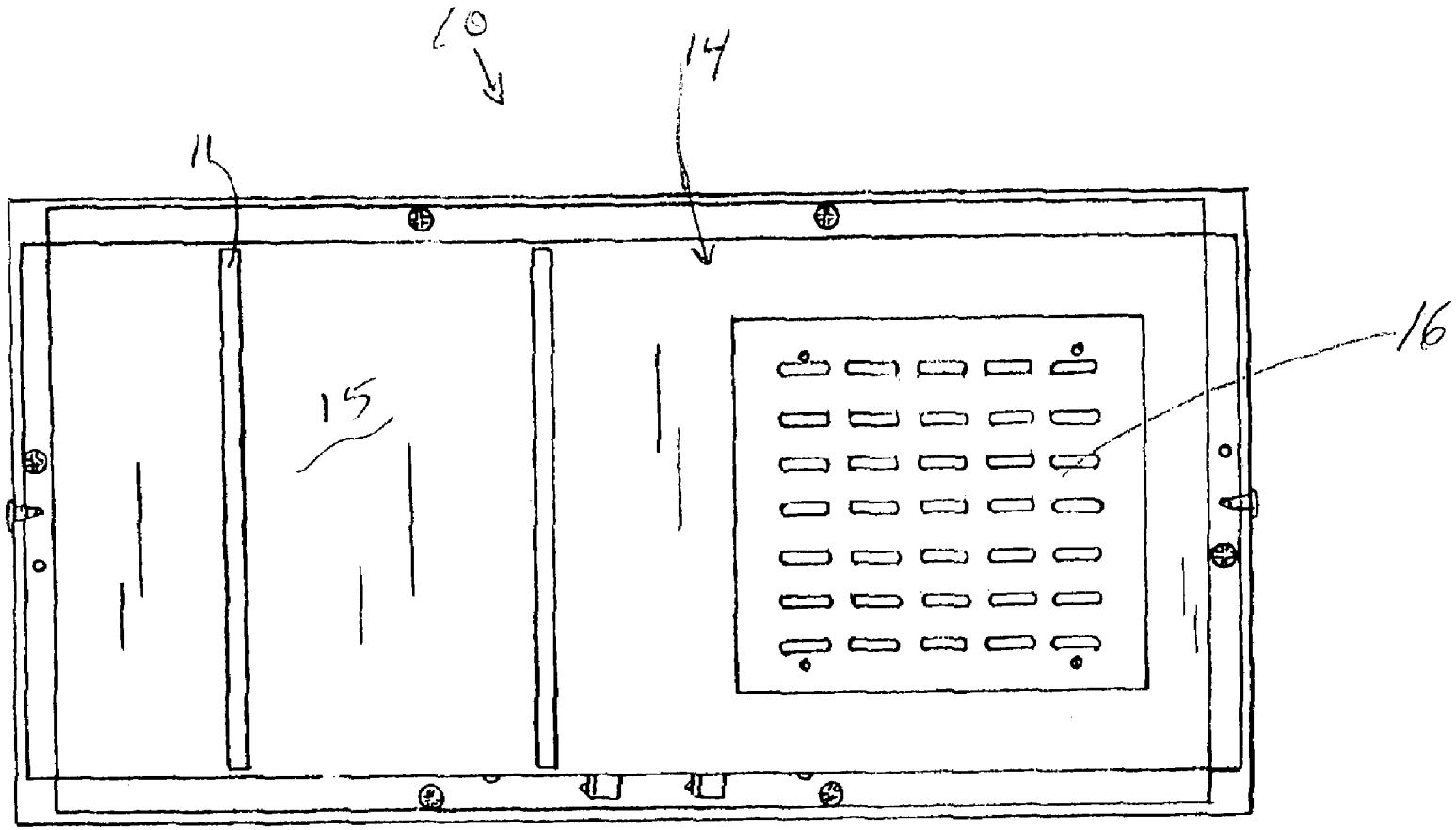
FIG. 3 is a top plan view of the single panel size box of the system of FIG. 2, without the ceiling support grid.
Figure 7:
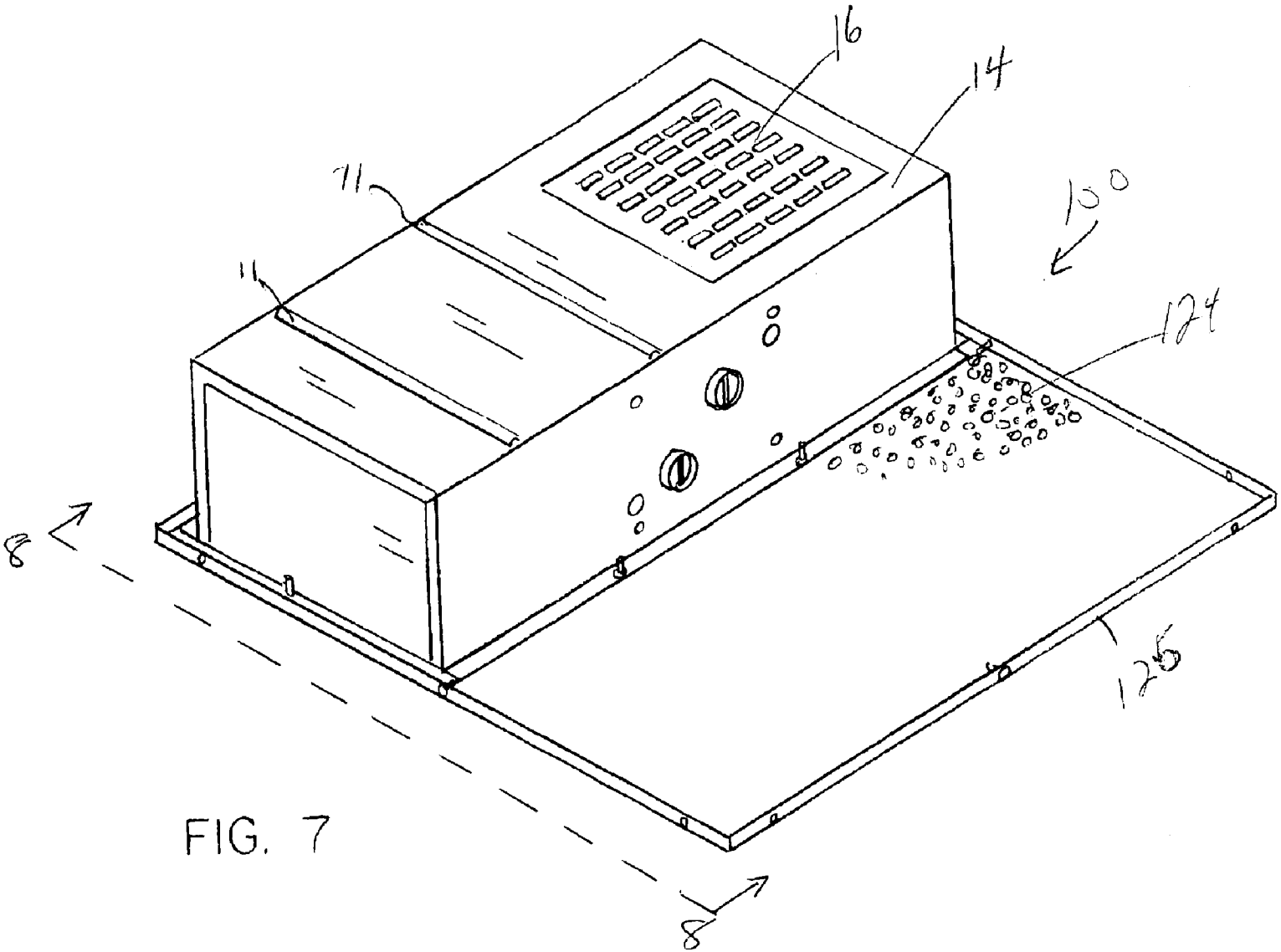
FIG. 7 is perspective view of a double-sized (two by two) embodiment of the system of the present invention, which is sized so as to completely fill the opening of a standard ceiling tile support grid, the grill openings shown only in part, on the right side, for simplicity of the figure.
Figure 8:
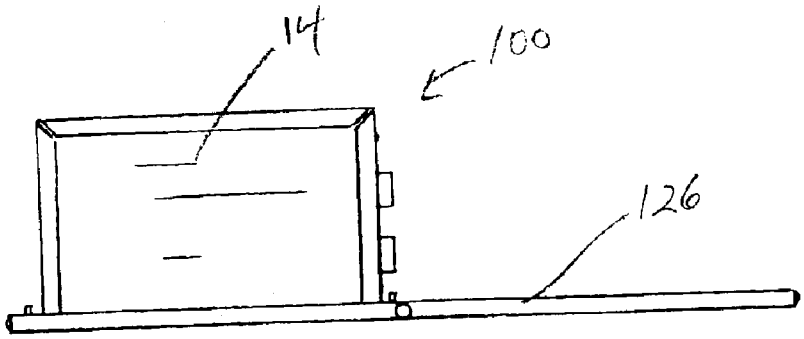
FIG. 8 is an end elevational view of the new system, taken from the direction indicated by line 8—8 in FIG. 7.
Figure 9:
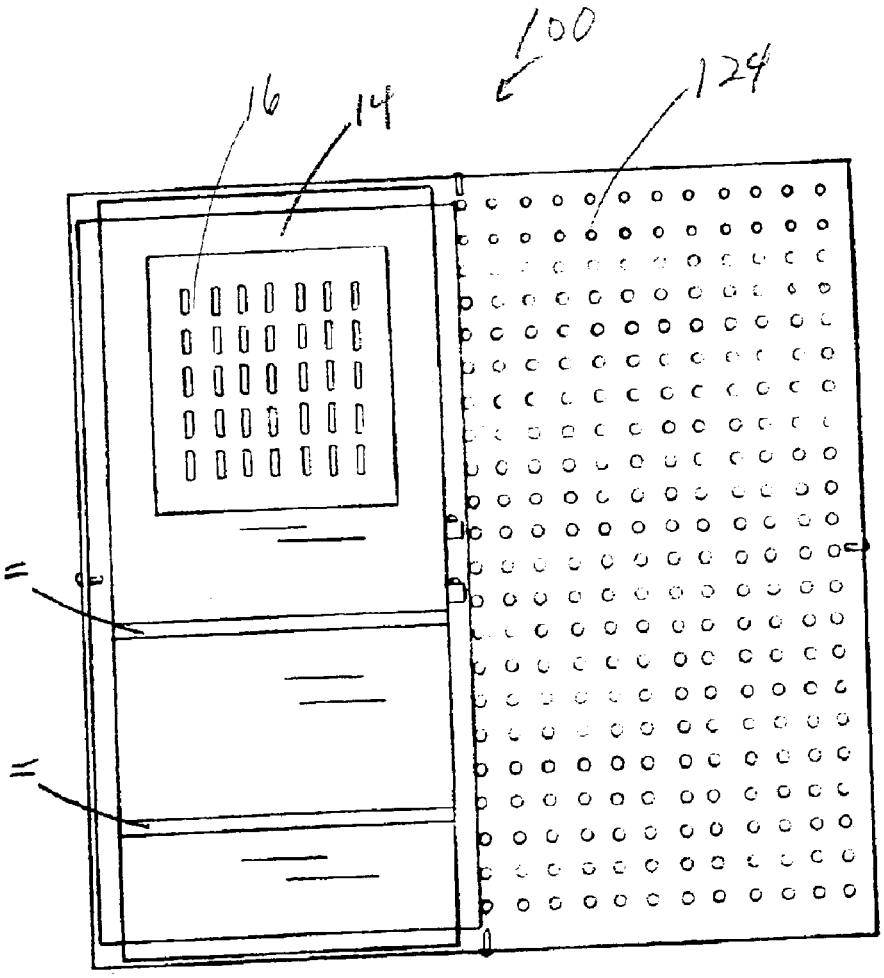
FIG. 9 is a top plan view of the system of FIG. 7, with grid openings for sound transfer illustrated across the entire right side of the panel.

With referenced to the drawings, and specifically in FIGS. 2–6, 10 generally designates a sound masking and paging system constructed in accordance with the present invention. An alternative system 100 is illustrated in FIGS. 7, 8 and 9. FIG. 2 illustrates the new masking/paging speaker system 10 positioned as supported on a standard ceiling grid 12, of the type used, for example, with two feet by two feet square ceiling tiles, divided in half by the length of one side of the speaker backbox 14. System 10 includes a backbox 14, which is about twenty-three and three quarter inches long, about ten and one-half inches wide and about six inches high. This size fits into one-half of the standard squared ceiling grid space and permits versatile rotation around plenum obstacles. Ceiling grids 12 are commonly used in the industry with openings of two sizes, one foot by two feet or two feet square. A grid 12 having an opening of one foot by two feet, as shown in FIG. 3 can be used, optionally with the lay-in tile speaker support 22 of FIG. 1 having a T-support bar 26 to assist in support of the new paging/masking system 10.

To further explain the lay-in tile speaker support system of FIG. 1, which is the subject of another pending application by the owner hereof; briefly, in that invention, there is provided a lay-in tile type of speaker support system for use with suspended ceilings. The system may support various sizes and types of speakers, such as stereo or paging systems. The system includes a speaker support base that can be perforated to improve acoustics by providing maximum free air space. The perforated surface also helps the appearance of the new system to visually blend in with the overall suspended ceiling in which the system is installed. The system further provides flanges that form a T-shaped member, when viewed in section, to support at least a portion of a ceiling tile cut to complete to ceiling grid opening. In one version the base and the flanges are constructed from a single sheet of material that is folded to form the flanges.

A preferably substantially solid support plate may be utilized to strengthen the base of the lay-in tile speaker system. When the support plate is utilized it is placed against the base and the speaker is mounted to the support plate. The speaker can be mounted with or without a backbox. The base is sized to fit within at least a portion of a conventional ceiling tile grid opening, and has substantially ninety degree corners so that the ceiling grid opening is completed by a ceiling tile cut to size with a simple, straight cut. In one embodiment of the FIG. 1 system the base occupies about one half of the ceiling grid opening and the cut-ceiling tile completes the other half of the grid opening. In another embodiment the base occupies about one quarter of the ceiling grid opening and the cut-ceiling tile occupies about three-quarters of the ceiling grid opening. If desired, the system of FIG. 1 can be also be sized to fill a complete ceiling tile opening. So, it can be readily seen that the FIG. 1 lay-in tile speaker support system offers a great degree of flexibility to the art of ceiling speaker installation.

Figure 3A:
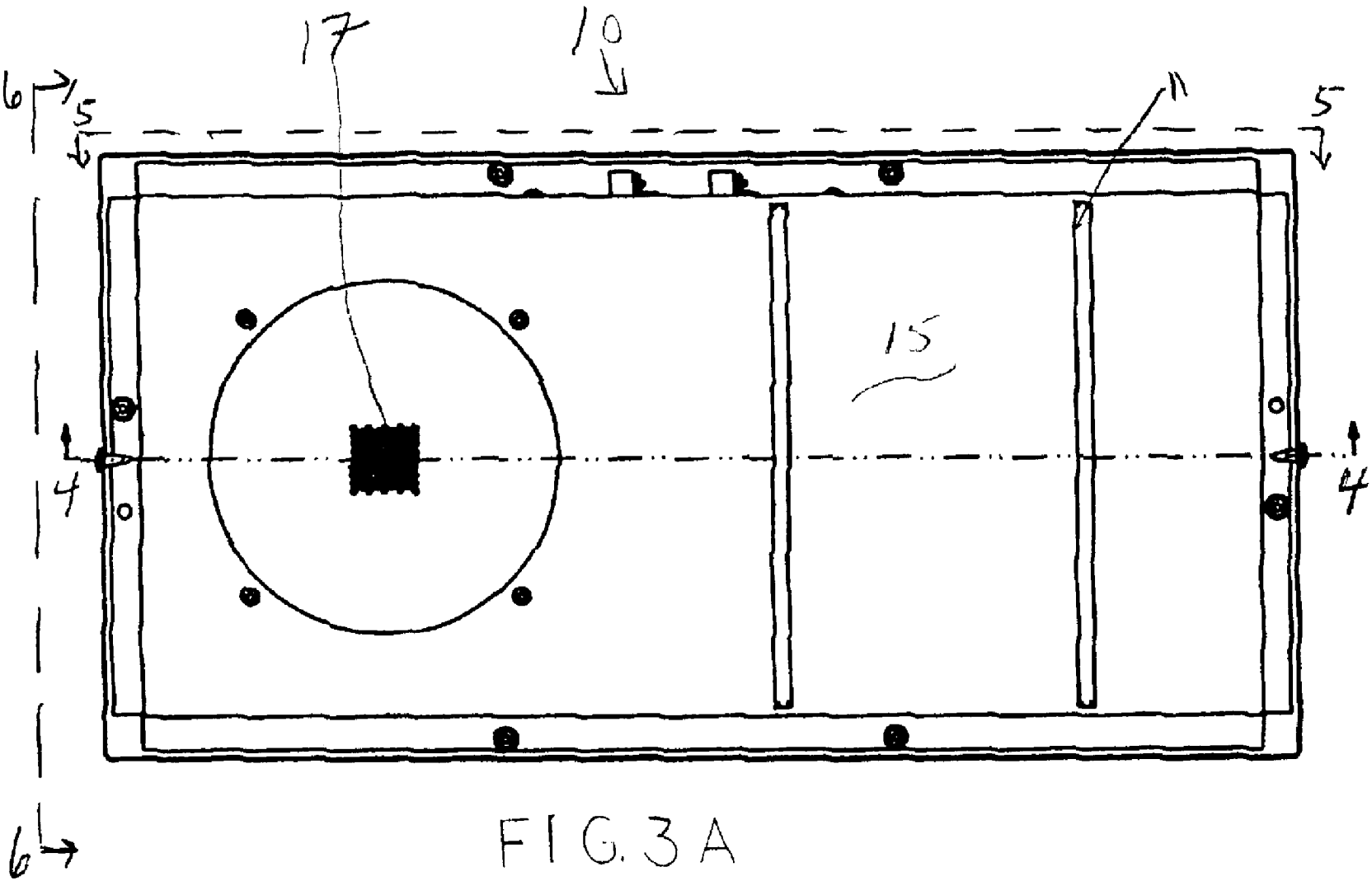
FIG. 3A is a top plan view of the single panel size box of the system of FIG. 2 (rotated end to end), showing an alternative sound opening construction for the masking speaker.

As seen in FIGS. 2–6, in the present sound masking/paging system backbox 14 has solid walls on four sides and a back surface 15 which is upwardly disposed in normal working position. Anti-vibration ribs 11 are optionally provided on the exterior surface of back surface 15, preferably transverse to the longitudinal axis of back wall 15. Backbox 14 is solid over at least one half of its length but provided over a portion of the other half of the back surface with perforations, as in the form of a screen or grille 16, to permit sound to flow therethrough. While shown as slots, the perforations forming grille 16 may be of any shape and various sizes and spacing, they are preferably round and sized so as to meet UL guidelines. In FIG. 3A, an alternative form of the sound grill is indicated at 17, in which the open area of the grille per se is much smaller and the openings are round holes. This version is particularly well suited for use with the masking speaker. It is to be understood however, that the grillwork for permitting passage of sound from either speaker can of course have a number of various designs which will function acceptably.

Figure 4:
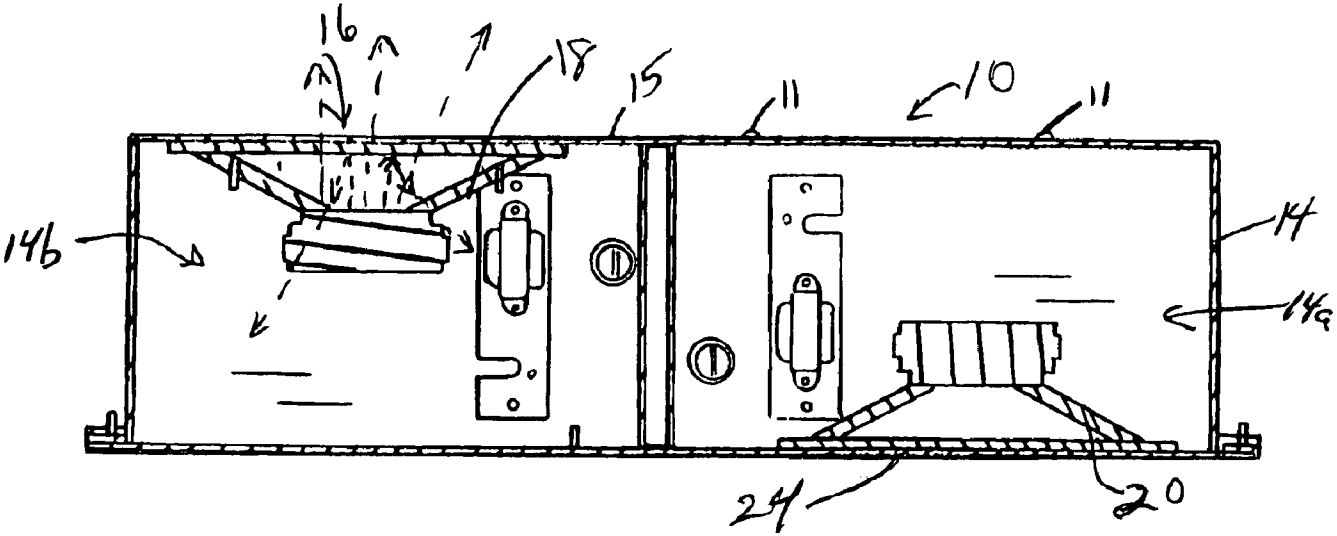
FIG. 4 is a longitudinal sectional view taken on line 4—4 of FIG. 3A, including sections of two loud speakers as positioned within the system of FIG. 2 for both sound masking and paging.

Backbox 14 is preferably divided internally into two sections. Although other sizes are conceivable which could be useful, in a preferred embodiment of the invention one internal section 14*a* has a volume of about 700 to about 730 cubic inches, to receive a paging speaker 20 and the other section 14*b* has a volume of about 650 to about 700 cubic inches to receive a masking speaker 18. FIG. 4 illustrates the position of both the sound masking speaker 18 and optional paging speaker 20, with the paging speaker 20 facing downwardly and the masking speaker 18 facing upwardly as they are disposed within backbox 14, when the box is installed in normal use position within a ceiling grille space, as indicated in FIG. 2. When speakers 18, 20 are in the positions shown in FIG. 4, masking speaker 18 faces toward grid 16 in the back of backbox 14, so that sound emits from speaker 18 upwardly. The sound will bounce off the interior of backbox 14 back wall 15 and then downwardly so as to be attenuated before reaching the ears of a person within hearing range of the new speaker system. Some masking sound goes through grill 16, into a ceiling plenum, and is therefore muffled.

Paging loudspeaker 20 faces downwardly, so that sound from the paging speaker is transmitted downwardly into the room below directly through the openings in a ceiling grid, or the perforated panel 24 of the described lay-in tile speaker system 22. The perforated panel 24 of support system 22 provides a support platform in backbox 14. Alternatively, the support platform 24 can be used independently of the rest of lay-in tile support system 22. That is, support platform 24 can be an open grille within grid 25 or a panel which is part solid and part grille.

Figure 5:
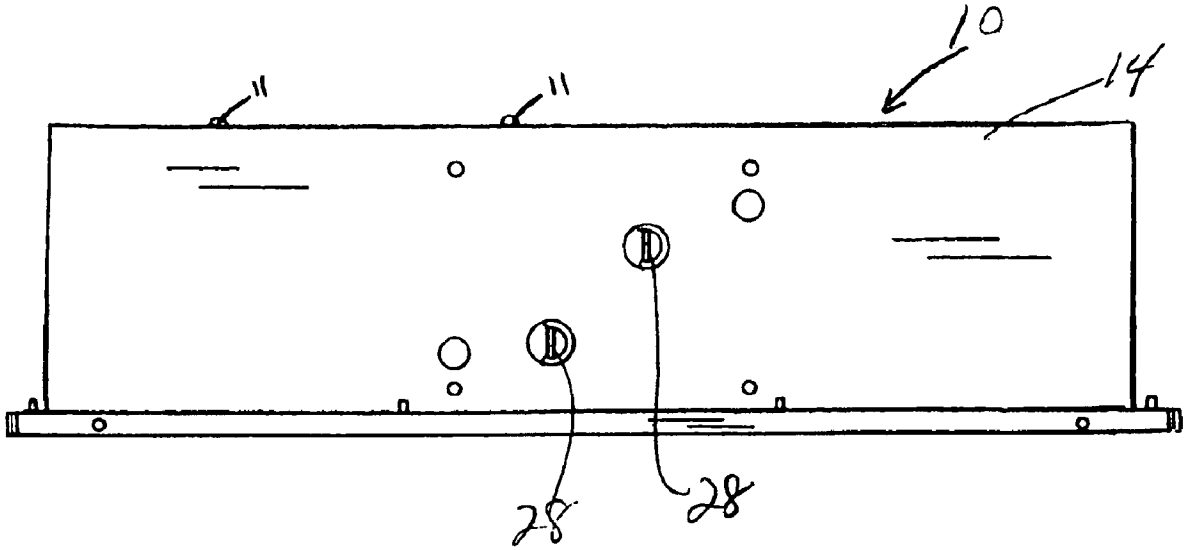
FIG. 5 is a side elevational view of the system of FIG. 2, taken from the direction shown by line 5—5 of FIG. 3A.
Figure 6:
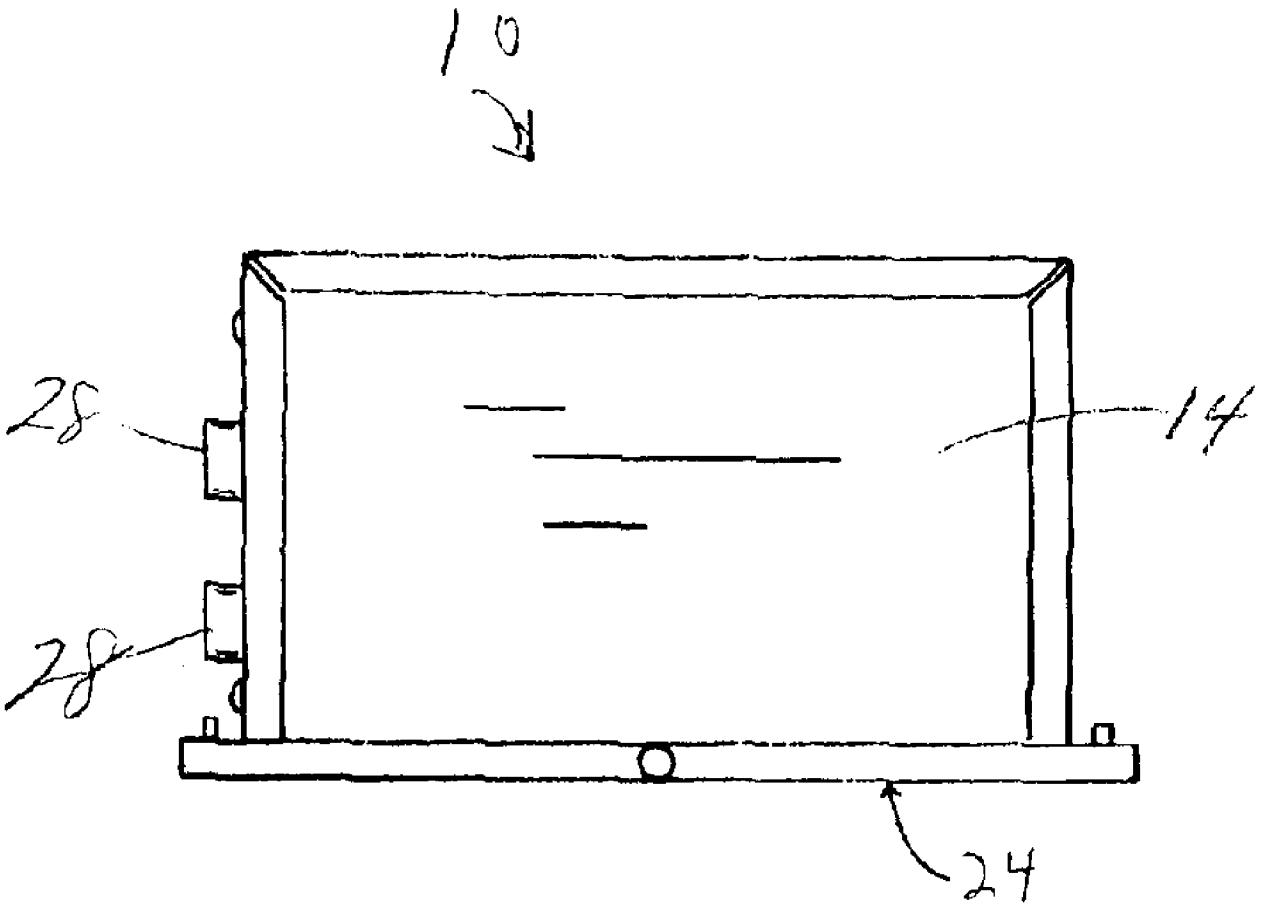
FIG. 6 is an end elevational view of the system of FIG. 2, taken from the direction of line 6—6 in FIG. 3A.

As seen for example, in FIG. 5, connectors 28 are mounted on a wall of backbox 14 to permit connection of various electrical wires (not shown), and the like, as may be necessary for operation of speakers 18, 20.

Thus, the one by two paging/masking system of the present invention includes a fine-perforated grille with an option integral T-bar for stability and ease of installation. Both drivers are mounted within a backbox engineered for optimum performance of each driver. Compact systems are supported by the t-bar grid and replace half of a two by two tile or one quarter of a two by four tile and are ideal for applications where ceiling to deck space is limited.

FIGS. 7–9 illustrate another embodiment of the new system, generally designated 100. System 100 is in many respects the same as system 10 and thus like parts have been numbered the same. The major difference is that system 100 is mounted on a two by two size grille 124, mounted in a grid 126, so that when mounted the system, from beneath, appears to be a two by two ceiling mounted sound grill, whereas system 10 is clearly a sound unit mounted on a grill of only one-half the size as grill 124.

The two by two paging /masking system of FIGS. 7, 8 and 9 likewise includes on paging driver 20 firing down and one masking driver 18 firing up within backbox 14 which is engineered for optimum performance of each driver. The backbox 14 is offset to one side of a finely perforated two by two grille, allowing the assembly to be rotated in the field to easily accommodate and "install around" plenum obstructions.

In both embodiments described and other useful variations thereof there are options available which include a rotary switch transformer tap selector with a knob-adjust control wired to the masking speaker or a volume control potentiometer (e.g. 50 ohm) with shaft-adjust volume level control to the masking speaker, which provides for fine adjustment of levels near bleed-through areas such as light fixtures, air returns, etc. The power of each of the masking speaker and the paging speaker ranges from about 12 W to about 20 W.

Although the present invention has been shown and described in considerable detail with respect to only a few exemplary embodiments thereof, it should be understood by those skilled in the art that we do not intend to limit the invention to the embodiments shown and described, since various modification, omissions, and additions may be made to the disclosed embodiments without materially departing from the novel teachings and advantages of the invention particularly in light of the foregoing teachings. Accordingly, it is intended that all such modifications, omissions, additions and equivalents as may be included within the spirit and scope of the invention as defined by the following claims be covered herein.

PARTS LIST

10 Sound Masking/Paging System
11 Anti-vibration ribs on 15
12 Ceiling Grid
14 Backbox
15 Backwall of 14
16 Grille
17 Alternate Grille
18 Masking Speaker
20 Paging Speaker
22 Lay-in tile Speaker Support System
24 Perforated Panel of 22
26 T-Support of 22
28 Electrical Connectors (clamps)

What is claimed is:

1. A speaker system for masking sound, comprising a support platform for supporting at least one speaker within a ceiling plenum, a backbox supported on the support platform within the ceiling plenum, the back box having a back wall with a grille formed therein, at least one speaker supported above the support platform in an upwardly facing position beneath and facing the grille in the back wall of the backbox, to thereby project masking sound upwardly, so that a portion of the masking sound will pass upwardly through the grille into the ceiling plenum and be muffled, and a portion of the masking sound will bounce off the grille and an interior of the backbox within which the system is supported and then downwardly, so as to be attenuated before reaching the ears of a person within hearing range of the speaker system and to thereby mask other sounds within hearing of the person wherein the at least one speaker is at least two speakers, one of said speakers being a masking speaker and facing upwardly and the other of said speakers being a paging speaker and facing downwardly, for providing paging capability simultaneously with the masking function of the speaker system.

2. The system of claim 1, and further comprising a grille supported on the support platform beneath the at least one speaker.

3. The system of claim 1, wherein the system is sized and shaped to occupy one-half the entire space of a standard size ceiling tile.

4. The system of claim 3, wherein the support platform is an open grid having an integral T-bar to support a one half standard sized piece of ceiling tile in the space in the support platform not occupied by the speaker system.

5. The system of claim 1, wherein the system is sized and shaped to occupy the entire space of a standard size ceiling tile.

6. The system of claim 1, wherein the backbox is divided, with one speaker being disposed on one side of the divider of the divided backbox and the other speaker being disposed within the other side of the divider of the divided backbox.

7. The system of claim 1, wherein the power of the masking speaker ranges from about 12 W to about 20 W.

8. The system of claim 1, wherein the power of the paging speaker ranges from about 12 W to about 20 W.

9. The system of claim 1, and further comprising a rotary switch transformer tap selector with knob-adjust control wired to the upwardly facing masking speaker.

10. The system of claim 1, and further comprising a volume control potentiometer with shaft-adjust volume level control wired to the masking speaker for fine adjustment of levels near bleed through areas.

11. The system of claim 1, wherein the at least one speaker is coaxial.

12. The system of claim 1, wherein the platform is uninterrupted by openings.

* * * * *